US007338053B2

(12) United States Patent
Dayton et al.

(10) Patent No.: US 7,338,053 B2
(45) Date of Patent: Mar. 4, 2008

(54) ELECTRONIC DEVICES FOR LUGGAGE

(75) Inventors: Douglas C. Dayton, Harvard, MA (US); Dave Duncanson, West Newbury, MA (US); Sung K. Park, Newton Center, MA (US)

(73) Assignee: Umagination Labs, L.P., Newton, MA (US)

( * ) Notice: Subject to any disclaimer, the term of this patent is extended or adjusted under 35 U.S.C. 154(b) by 38 days.

(21) Appl. No.: 11/448,417

(22) Filed: Jun. 7, 2006

(65) Prior Publication Data

US 2007/0007751 A1 Jan. 11, 2007

Related U.S. Application Data

(60) Provisional application No. 60/697,214, filed on Jul. 7, 2005.

(51) Int. Cl.
*B60K 11/00* (2006.01)

(52) U.S. Cl. ..... 280/37; 280/335; 280/206; 280/639; 280/9; 280/47.36; 280/47.371; 280/47.38; 280/47.26

(58) Field of Classification Search ..... 280/37, 280/335, 206, 639, 9, 47.36, 47.371, 47.38, 280/47.26
See application file for complete search history.

(56) References Cited

U.S. PATENT DOCUMENTS 3,934,669 A * 1/1976 Adams ..... 180/208
3,946,839 A 3/1976 Butler
4,094,374 A * 6/1978 Adams ..... 180/208
4,405,872 A 9/1983 Thomas
4,429,232 A 1/1984 Thomas et al.
4,539,497 A 9/1985 Boyer
4,728,937 A 3/1988 Hsu
4,913,252 A * 4/1990 Bartley et al. ..... 180/208
5,097,922 A * 3/1992 Stagi ..... 180/208
5,184,110 A 2/1993 Horng
5,500,636 A 3/1996 Mitchell
5,536,026 A 7/1996 Pozzobon et al.
6,291,901 B1 9/2001 Ćefo
6,337,528 B1 1/2002 Jung
6,396,178 B1 5/2002 Chiu
6,659,208 B2 * 12/2003 Gaffney et al. ..... 180/19.2
6,674,190 B2 1/2004 Chen
6,688,636 B2 2/2004 Han
6,769,588 B2 8/2004 Zheng
6,822,357 B2 11/2004 Hung
7,086,419 B2 * 8/2006 Takagi et al. ..... 138/121
7,088,419 B2 * 8/2006 Dowski et al. ..... 355/18
2002/0171213 A1 11/2002 Kim
2003/0112128 A1 6/2003 Littlechild et al.
2004/0246096 A1 12/2004 Queenan
2004/0246097 A1 12/2004 Queenan

FOREIGN PATENT DOCUMENTS

GB 2257873 1/1993

* cited by examiner

*Primary Examiner*—Christopher P. Ellis
*Assistant Examiner*—Cynthia F. Collado
(74) *Attorney, Agent, or Firm*—Fish & Richardson P.C.

(57) ABSTRACT

A wheeled transport device includes a body having a compartment configured to contain goods. Wheels are rotatably attached to a lower portion of the body, and a handle is attached to an upper portion of the body. The handle is configured to retract within a cavity defined by the body. An electronic device is mounted to the handle.

56 Claims, 5 Drawing Sheets

ELECTRONIC DEVICES FOR LUGGAGE

CROSS-REFERENCE TO RELATED APPLICATIONS

This application claims the benefit of U.S. Provisional Application No. 60/697,214, filed Jul. 7, 2005, and entitled "Electronic Devices for Luggage," which is incorporated by reference herein.

TECHNICAL FIELD

This invention relates to electronic devices for luggage.

BACKGROUND

Luggage devices are commonly used by travelers. In some cases, luggage devices can be wheeled by the user. A luggage device can, for example, include wheels attached to a lower portion of the luggage device, and a handle attached to an upper portion of the luggage device. Thus, the user can grasp the handle and push or pull the luggage device such that its wheels roll along the ground surface to convey the luggage device. Travelers can carry a wide range of goods in luggage devices.

SUMMARY

In one aspect, the invention features a wheeled transport device configured to be manually wheeled by a pedestrian user. The wheeled transport device includes a body defining a compartment configured to contain goods, at least one wheel disposed at a lower portion of the body and secured to the body for rotation along a surface upon which the user is walking, a handle attached to an upper portion of the body, and an electronic device mounted to the handle. The handle is configured to retract within a cavity defined by the body, and the electronic device is configured to deactivate when the handle is retracted.

In another aspect, the invention features a wheeled transport device configured to be manually wheeled by a pedestrian user. The wheeled transport device includes a body defining a compartment configured to contain goods, at least one wheel disposed at a lower portion of the body and secured to the body for rotation along a surface upon which the user is walking, a handle attached to an upper portion of the body, and a WiFi locating device mounted to the handle. The handle is configured to retract within a cavity defined by the body, and the WiFi locating device is adapted to detect WiFi signals.

In a further aspect, the invention features a wheeled transport device configured to be manually wheeled by a pedestrian user. The wheeled transport device includes a body defining a compartment configured to contain goods, at least one wheel disposed at a lower portion of the body and secured to the body for rotation along a surface upon which the user is walking, a handle attached to an upper portion of the body, and an electronic device mounted to the grip portion of the handle. The handle includes a grip portion configured to be grasped by a user, and the handle is configured to retract within a cavity defined by the body.

In yet another aspect, the invention features a wheeled transport device configured to be manually wheeled by a pedestrian user. The wheeled transport device includes a body defining a compartment configured to contain goods, at least one wheel disposed at a lower portion of the body and secured to the body for rotation along a surface upon which the user is walking, and a handle attached to an upper portion of the body. The handle is configured to retract within a cavity defined by the body, and includes a first portion and a second portion that is detachable from the first portion. An electronic device is mounted to the second portion of the handle.

Embodiments can include one or more of the following features.

In some embodiments, the wheeled transport device further includes a switch configured to electrically connect the electronic device to a power supply.

In some embodiments, the switch is positioned within the handle.

In some embodiments, the switch is configured to disconnect electrical supply to the electronic device when the handle is retracted.

In some embodiments, the wheeled transport device further includes an electrical contact configured to contact the switch when the handle is extended. The electrical contact is electrically connected to the electronic device.

In some embodiments, the electrical contact is positioned within the cavity.

In some embodiments, the power supply is positioned within the body.

In some embodiments, the power supply includes a battery.

In some embodiments, the power supply includes an electric generator operably coupled to the wheel and configured to produce electrical energy as the user wheels the device along the surface.

In some embodiments, the power supply is positioned within the handle.

In some embodiments, the electronic device includes a WiFi locator, a clock, a custom computer, a PDA, a calculator, an expense counter, a cell phone, a GPS device, and/or a luggage locating device.

In some embodiments, the electronic device is releasably attached to the handle.

In some embodiments, the electronic device is constructed to be retained within a recess defined by the handle.

In some embodiments, the handle is a telescoping handle.

In some embodiments, the handle includes two substantially parallel members and a cross member that connects the substantially parallel members.

In some embodiments, the electronic device is attached to the cross member.

In some embodiments, the electronic device is releasably attached to the cross member.

In some embodiments, the electronic device is constructed to be retained within a recess defined by the cross member.

In some embodiments, the electronic device is attached to at least one of the substantially parallel members.

In some embodiments, the electronic device is attached to each of the substantially parallel members.

In some embodiments, the wheeled transport device includes a wheeled luggage device.

In some embodiments, the WiFi locating device is configured to retract within the cavity when the handle is retracted.

In some embodiments, the WiFi locating device is not visible to a user when retracted within the cavity.

In some embodiments, the cavity is defined by relatively hard surfaces to protect the WiFi locating device from damage when the WiFi locating device is retracted.

In some embodiments, the hard surfaces of the cavity include a thermoplastic material.

In some embodiments, the WiFi locating device is configured to deactivate upon retracting the handle.

In some embodiments, the wheeled transport device further includes an electrical switch, and the WiFi locating device includes a contact member configured to electrically contact the electrical switch when the handle is extended.

In some embodiments, the wheeled transport device further includes a power supply adapted to provide power to the WiFi locating device.

In some embodiments, the power supply is positioned within the body.

In some embodiments, the power supply is positioned within the handle.

In some embodiments, the power supply includes an electric generator operably coupled to the wheel and configured to produce electrical energy as the user wheels the device along the surface.

In some embodiments, the electric generator is positioned within the body.

In some embodiments, the wheeled transport device further includes an indicator connected to the WiFi locating device.

In some embodiments, the indicator is mounted to the handle.

In some embodiments, the indicator is adapted to indicate a strength of the WiFi signals detected by the WiFi locating device to a user.

In some embodiments, the indicator includes a monitor that visually indicates the strength of the WiFi signals detected by the WiFi locating device to the user.

In some embodiments, the indicator includes an audio device that audibly indicates the strength of the WiFi signals detected by the WiFi locating device to the user.

In some embodiments, the grip portion defines a recess, and the electronic device is mounted within the recess.

In some embodiments, the wheeled transport device further includes an electrical contact positioned within the recess, and the electrical contact is connected to a power supply.

In some embodiments, the electronic device includes an electrical contact. The electrical contact of the electronic device is configured to contact the electrical contact within the recess when the electronic device is mounted within the recess.

In some embodiments, multiple electronic devices are mounted to the grip portion of the handle.

In some embodiments, the electronic device is one of a plurality of interchangeable devices configured to be releasably mounted to the handle.

In some embodiments, the interchangeable electronic devices are configured to be releasably mounted to the grip portion of the handle.

In some embodiments, the plurality of interchangeable electronic devices include a WiFi locator, a clock, a custom computer, a PDA, a calculator, an expense counter, a cell phone, a GPS device, and/or a luggage locating device.

In some embodiments, the first and second portions of the handle include mating features adapted to engage one another to secure the first and second portions to one another.

In some embodiments, the mating features include a projection and a slot configured to receive the projection.

In some embodiments, the handle includes a locking member adapted to lock the first and second portions in a joined configuration.

In some embodiments, the locking member includes a mechanical fastener.

In some embodiments, the wheeled transport device further includes a power supply adapted to provide the electronic device with energy.

In some embodiments, the power supply is positioned within the handle.

In some embodiments, the power supply is positioned within the second portion of the handle.

In some embodiments, the power supply is positioned includes electrical contacts electrically connected to the power supply. The electrical contacts of the first portion are configured to mate with electrical contacts of the second portion when the first and second portions are secured to one another.

Embodiments may include one or more of the following advantages.

In some embodiments, the electronic device can be automatically activated upon extending the handle and/or automatically deactivated upon retracting the handle. This can simplify use of the electronic device by preventing the user from having to perform the additional steps of turning the electronic device on and off. Embodiments in which the electronic device is automatically deactivated when the handle is retracted can further help to ensure that the user complies with airline regulations, which require the deactivation of many types of electronic devices during flight.

In certain embodiments, the electronic device is attached to a grip portion of the handle. This can help to provide convenience to the user. For example, displays of the electronic devices can be conveniently located in a location that is easily visible to the user during use. In some cases, the presence of the electronic device on the handle can prevent the user from having to access additional electronic devices, such as laptop computers or PDAs, while toting the luggage device.

In some embodiments, the luggage devices include an electric generator that is operatively attached to the wheels of the luggage device. This arrangement can help to generate energy to be provided to the electronic devices.

In certain embodiments, a portion of the handle including the electronic device is detachable from the remainder of the handle. This can help to prevent theft and/or damage to the electronic device.

In some embodiments, the luggage devices include multiple, interchangeable electronic devices that can be operatively attached to the handle. This can help to provide the user and/or the manufacturer with the ability to customize the luggage device to provide any of various desired functions.

Other features and advantages are in the description, the drawings, and the claims.

DESCRIPTION OF DRAWINGS

Like reference symbols in the various drawings indicate like elements.

DETAILED DESCRIPTION

In general, the luggage devices include an electronic device (e.g., a WiFi detector) that is attached to a retractable handle. The electronic device can generally be retracted into a body of the luggage device along with the handle. In some cases, the electronic device can be automatically activated upon extending the handle and/or automatically deactivated upon retracting the handle. In certain cases, the portion of the handle that includes the electronic device is detachable from the rest of the handle.

Figure 1:
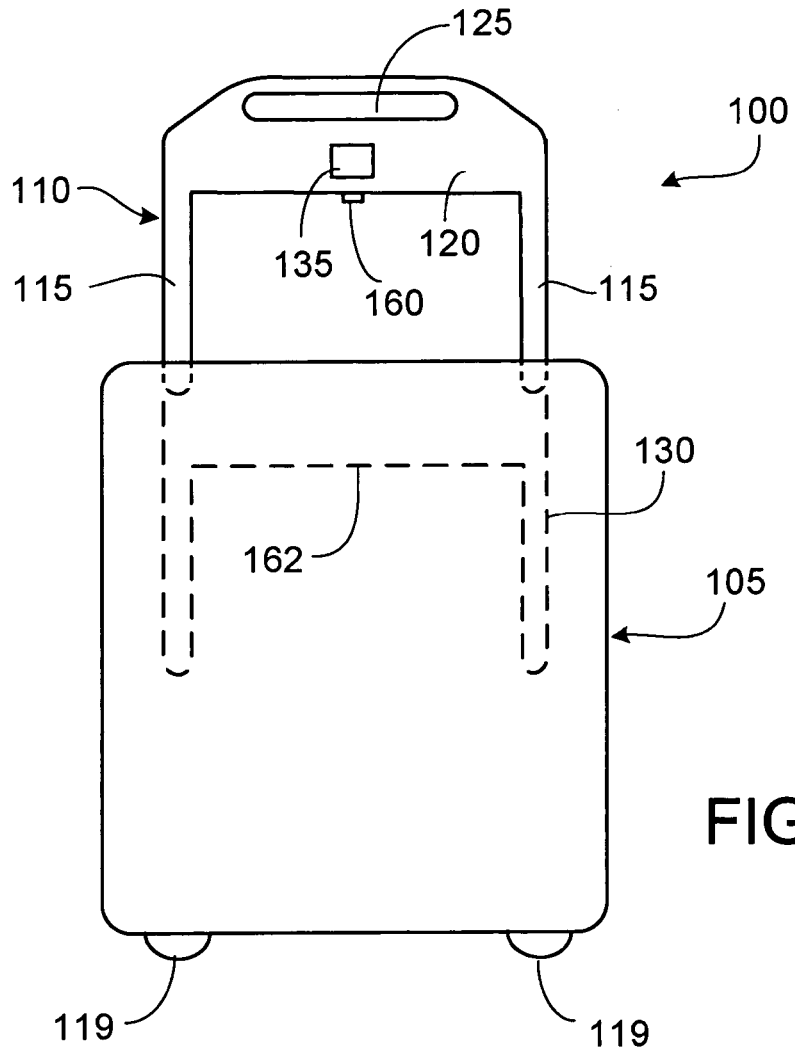
FIG. 1 is a front view of an embodiment of a luggage device including a retractable handle with an electronic device.

Referring to FIG. 1, a luggage device 100 includes a body 105 and a retractable handle 110. Retractable handle 110 can be retracted into an interior region of the body 105. A WiFi locator 135 is mounted within handle 110. WiFi locator 135 can detect wireless signals, such as wireless internet signals. During use, the user can, for example, determine whether a wireless signal is present in the area by examining the handle of the luggage device rather than having to access an additional device, such as a laptop computer or a PDA.

Body 105 defines a cavity 130 that is sized and shaped to receive handle 110 when it is retracted. The portion of body 105 that defines cavity 130 can be formed of any of various materials. In some embodiments, this portion of body 105 is formed of one or more durable materials in order to help protect WiFi locator 135 when handle 110 and WiFi locator 135 are retracted. This portion of body 105 can, for example, be formed of any of various metals or plastics. In some embodiments, the interior region of cavity 130 includes a soft material, such as foam or cloth, to provide WiFi locator 135 with added cushion, which can further help to prevent WiFi locator 135 from being damaged while handle 110 is retracted.

Handle 110 includes two parallel members 115 and a grip portion 120 that is attached to and connects parallel members 115. Handle 110 includes a recess 125 through which the user can place his or her hand to grasp grip portion 120 in order to push and/or pull luggage device 100. The user can, for example, tote the luggage device along a ground surface such that wheels 119, which extend from a bottom surface of the luggage device, roll on the ground surface. Parallel members 115 and/or grip portion 120 can be formed of any of various materials, such as metals and/or plastics. In some embodiments, the region of grip portion 120 that is grasped by the user during use (e.g., the region of grip portion 120 adjacent recess 125) is formed of a soft material, such as a soft plastic or rubber. As a result, grip portion 120 can provide comfort to the user during use.

Figure 2:
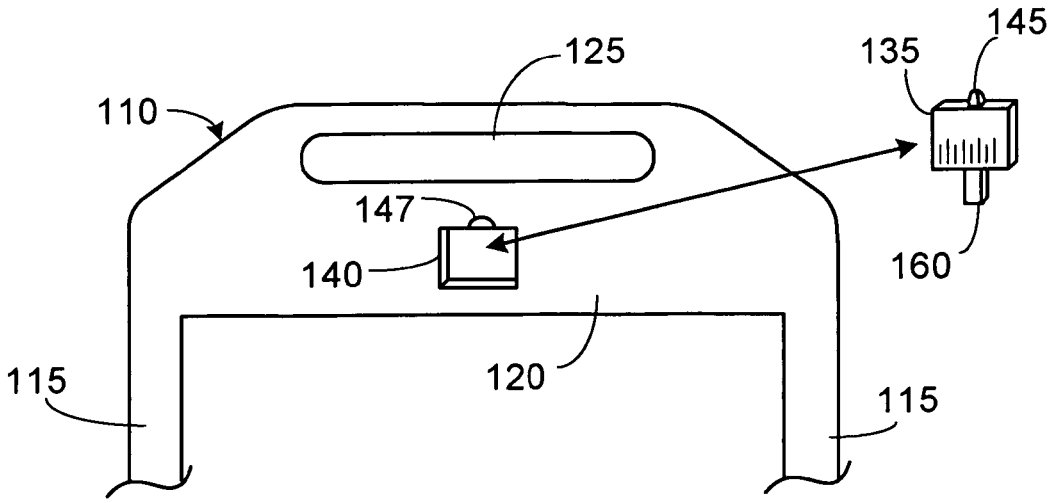
FIG. 2 is a partial, enlarged view of the handle of the luggage device of FIG. 1.

WiFi locator 135, as shown in FIGS. 1 and 2, can be positioned on the face of grip portion 120 such that WiFi locator 135 (e.g., a display unit of WiFi locator 135) is visible to the user while the luggage device is being toted. WiFi locator 135 includes a power source (not shown) that is configured to provide energy to electrical components of WiFi locator 135 to permit operation of WiFi locator 135. In some embodiments, the power source is a battery (e.g., a primary or secondary battery) that is contained within a battery compartment of WiFi locator 135. However, any of various other types of power sources, such as fuel cells, solar cells, and/or A/C adaptors, can alternatively or additionally be used. WiFi locator 135 can be attached to grip portion 120 so that WiFi locator 135 can be viewed by the user during use.

In certain embodiments, WiFi locator 135 is releasably attached to grip portion 120. Referring to FIG. 2, for example, grip portion 120 includes a cavity 140 that is sized and shaped to receive WiFi locator 135. A blind hole 147 is also formed in grip portion 120. Blind hole 147 extends from cavity 140 into grip portion 120. WiFi locator 135 includes a resilient prong 145 that is configured (e.g., sized and shaped) to snap into blind hole 147 when WiFi locator 135 is positioned within cavity 150.

WiFi locator 135 is also equipped with a button switch 160 that is configured to activate and deactivate WiFi locator 135. Button switch 160 can be arranged such that it deactivates WiFi locator 135 when handle 110 is retracted and activates WiFi locator 135 when handle 110 is extended. Button switch 160 is configured such that WiFi locator 135 is deactivated upon depressing the switch and activated upon releasing the switch, or vice versa. To allow such activation and deactivation, button switch 160 can include a conductive element that completes an electrical circuit connecting WiFi locator 135 to the power source contained therein when button switch 160 is released, and interrupts the electrical circuit when button switch 160 is depressed. As discussed below, the button switch can be activated and deactivated by arranging button switch 160 along handle 110 so that the button of button switch 160 is depressed by a surface of body 105 when handle 110 is retracted. Any of various types of button switches can be used.

To releasably attach WiFi locator 135 to grip portion 120, the user can position WiFi locator 135 within cavity 140 such that only the edge of WiFi locator 135 that includes resilient prong 145 remains outside of cavity 150. Button switch 160 of WiFi locator 135 can be positioned such that its button extends through an aperture defined in the lower portion of grip portion 120 and below grip portion 120. The user can then apply a force to the edge of WiFi locator 135 including resilient prong 145 causing resilient prong 145 to deflect and then snap into blind hole 147. As an alternative to or in addition to the above-described technique for releasably mounting WiFi locator 135 to grip portion 120, any of various other suitable techniques can be used. Examples of such techniques include other snap-fitting techniques, fastening techniques that involve the use of mechanical fasteners (e.g., screws, hook and loop fasteners, quarter turn fasteners), friction fit techniques, interference fit techniques, track systems, and techniques involving the use of adhesives.

During use, handle 110 can be arranged in an extended position, as shown in FIG. 1, so that the user can roll luggage device 100 along a surface. For storage, handle 110 can be retracted into recess 130, which is formed in the interior region of body 105. Upon fully retracting handle 110, the button of button switch 160, which extends below the lower surface of grip portion 120, contacts an inner surface of recess 130, causing the button to be depressed. As a result, WiFi locator 135 is deactivated. When the user extends handle 110, the button of button switch 160 is released, which results in the activation of WiFi locator 135.

Figure 3:
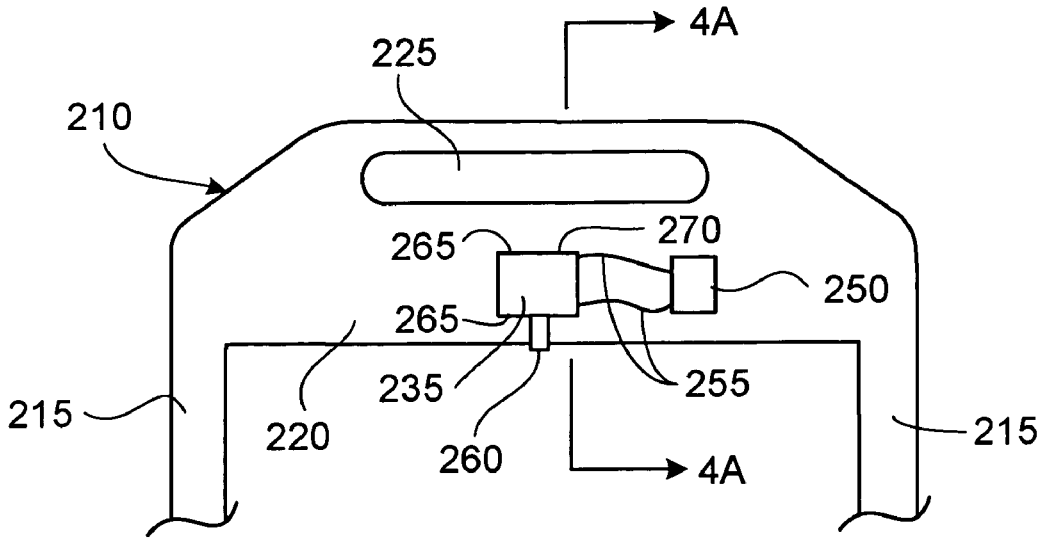
FIG. 3 illustrates an embodiment of a luggage device handle including an electronic device connected to a power source in the handle.
Figure 4A:
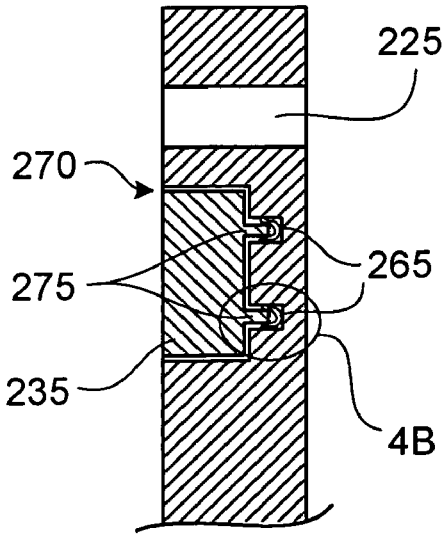
FIG. 4A is a cross-sectional view of the luggage device handle of FIG. 3 taken along line 4A-4A.
Figure 4B:
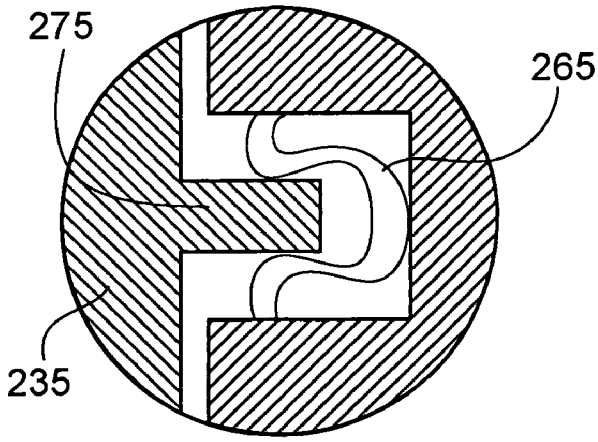
FIG. 4B is an enlarged view of region 4B in FIG. 4A.

While the power source was described above as being located within WiFi locator 135, in certain embodiments, the power source can be positioned external to the WiFi locator. In some embodiments, the power source is positioned within the retractable handle. As shown in FIG. 3, for example, a luggage device handle 210 has a grip portion 220 that includes a battery 250 and a WiFi locator 235. Battery 250 is electrically connected by wires 255 to conductive tracks 265, which extend along the surface of a cavity 270 formed within grip portion 220. WiFi locator 235 can be positioned within cavity 270 to electrically connect WiFi locator 235 to conductive tracks 265 and thus to battery 250. As shown in FIG. 4A, WiFi locator 235 includes conductive members 275 that are configured to fit within elongated sections of cavity 270 in which conductive tracks 265 are positioned. Conductive members 275 of WiFi locator 235 contact conductive tracks 265, which creates an electrical circuit extending between battery 250 and WiFi locator 235. In some embodiments, as shown in FIG. 4B, conductive tracks 265 are conductive spring clips that clip onto conductive members 275 when WiFi locator 235 is positioned within cavity 270. The spring clips, in addition to providing an electrical connection, can help to retain WiFi locator 235 within cavity 270. In certain embodiments, conductive members 275 are shaped similarly to the spring clips to further enhance the ability of the spring clip to retain WiFi locator 235 within cavity 270. Alternatively or additionally, any of the various other fastening techniques described above can be used to help secure WiFi locator 235 within cavity 270.

WiFi locator 235 also includes a button switch 260, which is similar to button switch 160 described above. Button switch 260 can be configured to deactivate WiFi locator 235 (e.g., by interrupting the electrical circuit formed between WiFi locator 235 and battery 250) when handle 210 is retracted into the body of the luggage device and to activate WiFi locator 235 when handle 210 is extended.

Figure 5:
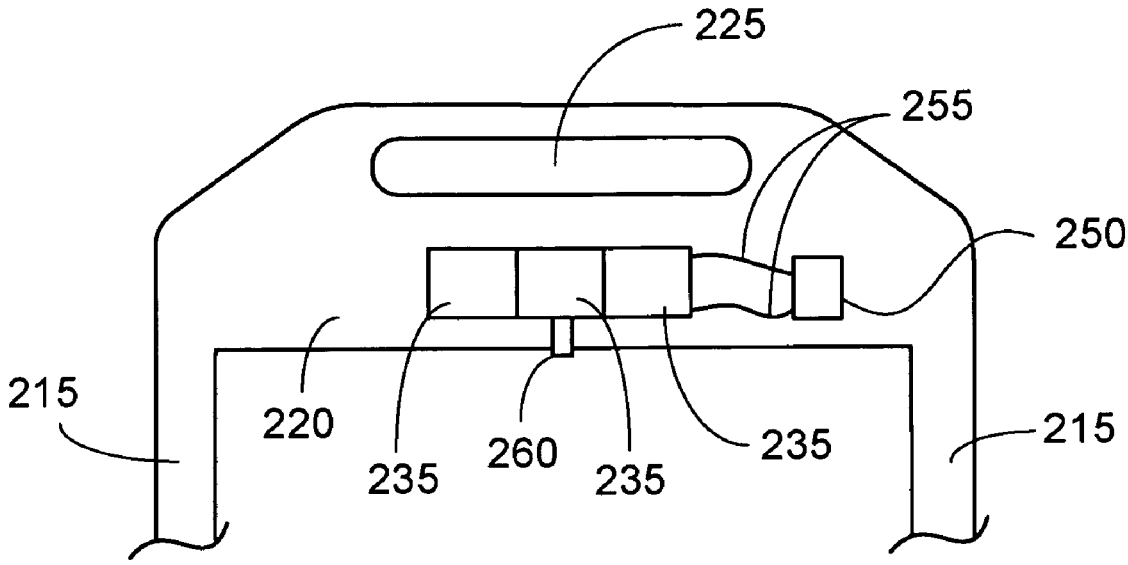
FIG. 5 illustrates an embodiment of a luggage device handle including multiple electronic devices connected to a power source in the handle.

In some embodiments, multiple electronic devices can be mounted to grip portion 220. As shown in FIG. 5, for example, cavity 270 is sized to receive multiple electronic devices 236 in addition to WiFi locator 235. The electronic devices can be any of various devices. Examples of electronic devices include WiFi locators, clocks, custom computers, PDAs, calculators, expense counters, cell phones, GPS devices, and luggage locating devices (e.g., a wireless transmitter/receiver, an RF transmitter/receiver). In embodiments in which one or more of the electronic devices is a luggage locating device, the user can retain the receiver of the device while the transmitter remains attached to the luggage. Thus, the user can locate his or her luggage by receiving wireless transmission from the transmitter. Each of electronic devices 236 can include conductive members (similar to conductive members 275 of WiFi locator 235) that contact conductive tracks 265 when the electronic devices are positioned within cavity 270. Consequently, each of the multiple electronic devices can be powered by battery 250. In a manner similar to that described above, button switch 260 can be depressed to cut off the electrical current to each of electronic devices 235. Thus, upon retracting handle 210 into the body of the luggage device, each of the electronic devices can be deactivated.

In order to secure the electronic devices in place along cavity 270, each of the electronic devices can include fastening members that engage grip portion 220 and prevent movement along the length of grip portion 220. Alternatively or additionally, an end piece or insert including fastening members can be positioned at the opening of cavity 270 in order to prevent the electronic devices from sliding out of cavity 270.

In certain embodiments, multiple interchangeable electronic devices can be provided (e.g., sold with the luggage device or sold separately). Depending on the user's needs, certain of the devices can be interchanged for others.

Figure 6:
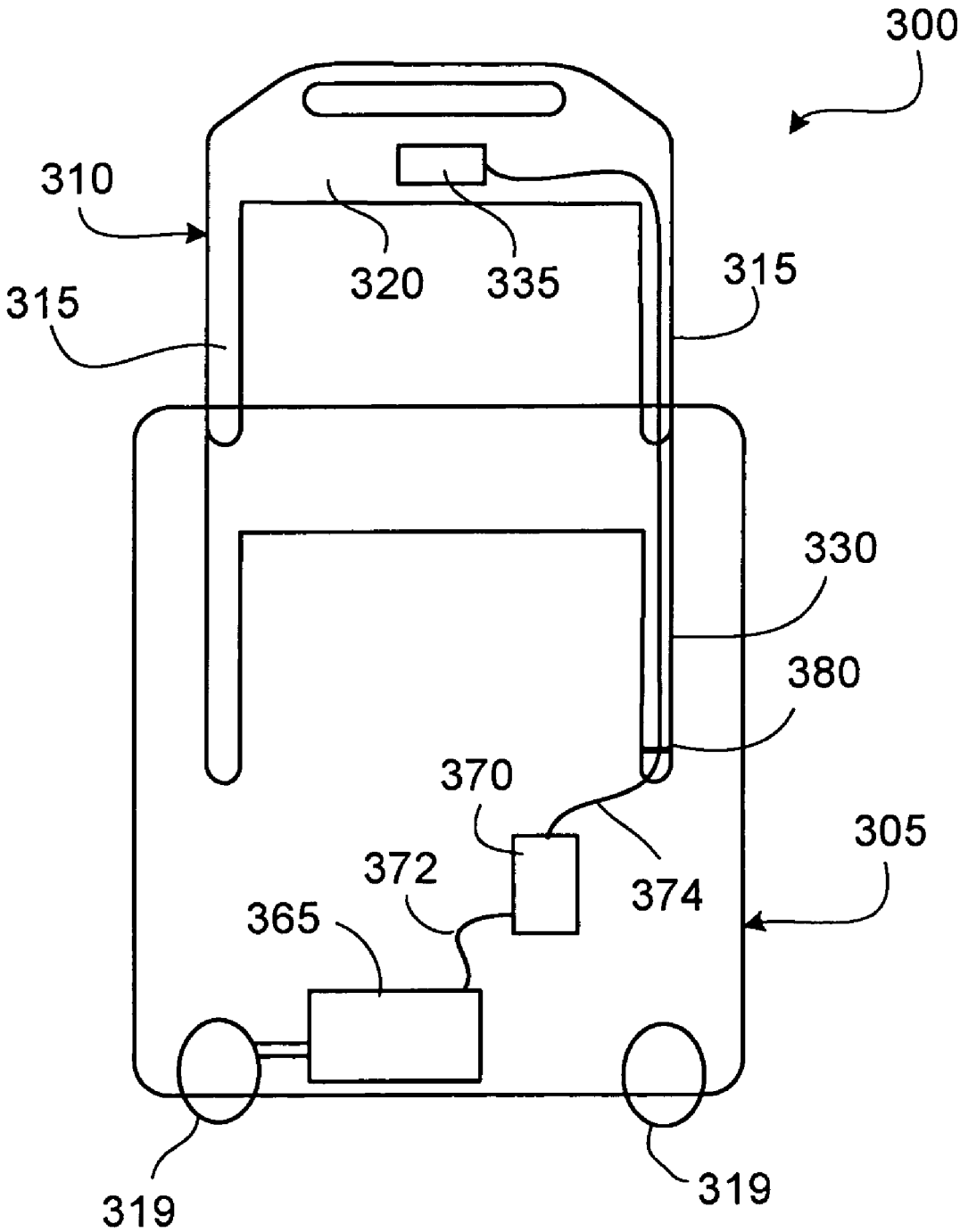
FIG. 6 illustrates an embodiment of a luggage device including a retractable handle with an electronic device and a generator configured to power the electronic device.

In some embodiments, the power source can be housed within the body of the luggage device. Referring to FIG. 6, a luggage device 300 includes a retractable handle 310 and a body 305. Like the embodiments described above, a grip portion 320 of handle 310 includes a WiFi locator 335. Body 305 of luggage device 300 houses a generator 365 and a rechargeable battery 370. Generator 365 is operatively attached to a wheel 319 of luggage device 300 such that rotation of wheel 319 generates energy within generator 365. Rechargeable battery 370 is connected to generator 365 by a wire 372. Energy generated within generator 365 can be transferred via wire 372 to battery 370 where it can be stored for use.

Battery 370 is connected to WiFi locator 335 by wire 374. Thus, when WiFi locator 335 is activated, energy can be transferred via wire 374 from battery 370 to WiFi locator 335. Wire 374 can be electrically connected to WiFi locator 335 using any of the various configurations and techniques described above, as well as any other suitable configurations and techniques. In some embodiments, luggage device 300 includes a switch that is configured to activate WiFi locator 335 when handle 310 is extended and deactivate WiFi locator 335 when handle 310 is retracted. As shown in FIG. 6, for example, a button switch 380 is positioned near the bottom of a recess 330. Upon retracting handle 310, a bottom surface of handle 310 depresses button switch. This prevents electrical current from flowing to WiFi locator 335, thereby deactivating WiFi locator 335. When handle 310 is extended, button switch 380 is released, which permits activation of WiFi locator 335. While the electrical switch has been described as a button switch located within the recess that receives the handle, any of the various other types of electrical switches described herein can be used. Similarly, the electrical switch can be positioned at any of various points along the electrical circuit. The electrical switch can, for example, be positioned within the handle of the luggage device.

While body 305 includes both generator 365 and battery 370, the body can alternatively include the generator and not the battery. In embodiments in which the body includes the generator and not the battery, the generator can be connected directly to WiFi device 335 via a wire. As the luggage device is wheeled, energy generated by generator 365 can be applied to WiFi device 335. In certain embodiments, the luggage device includes no generator. In such embodiments, battery 370 can be used to power WiFi locator 335 in much the same way as described above. In cases in which a relatively large or heavy battery is used, it may be beneficial to house the battery in the body of the luggage device.

Examples of generators and luggage devices including generators can be found in commonly owned U.S. Patent Application No. 60/599,360, filed Aug. 6, 2004, and entitled "Electrical Power Generation," which is incorporated by reference herein.

While several embodiments have been described above, other embodiments are possible.

As an example, while many of the embodiments above describe a WiFi locator mounted to the handle of a luggage device, any of various other electronic devices can alternatively or additionally be mounted to the handle. Examples of some other types of electronic devices have been described above.

As a further example, while the electronic devices and handle of the embodiments described above describe various structures and techniques that can be used to releasably attach the electronic device to the handle, any of various other structures and techniques can alternatively or additionally be used. As an example, WiFi locator 135 and grip portion 120 can include mating geometries that can retain WiFi locator 135. As another example, WiFi locator 135 can be releasably attached to grip portion 120 using any of various mechanical fasteners, such as screws, snaps, and hook and loop fasteners.

As another example, while the electronic devices have been described as being releasably attached to the handle, the electronic devices can alternatively or additionally be permanently attached to the handle. The electronic devices can, for example, be adhesively attached, welded, or bonded within a cavity defined by the handle.

As an additional example, while the electronic devices of the embodiments above have been described as being attached to the grip portion of the luggage device handle, the electronic devices can alternatively or additionally be attached to other portions of the handle, such as the parallel members that are attached to the grip portion. It is also contemplated that the electronic devices could be attached to other portions of the luggage device, such as the body of the luggage device.

Figure 7:
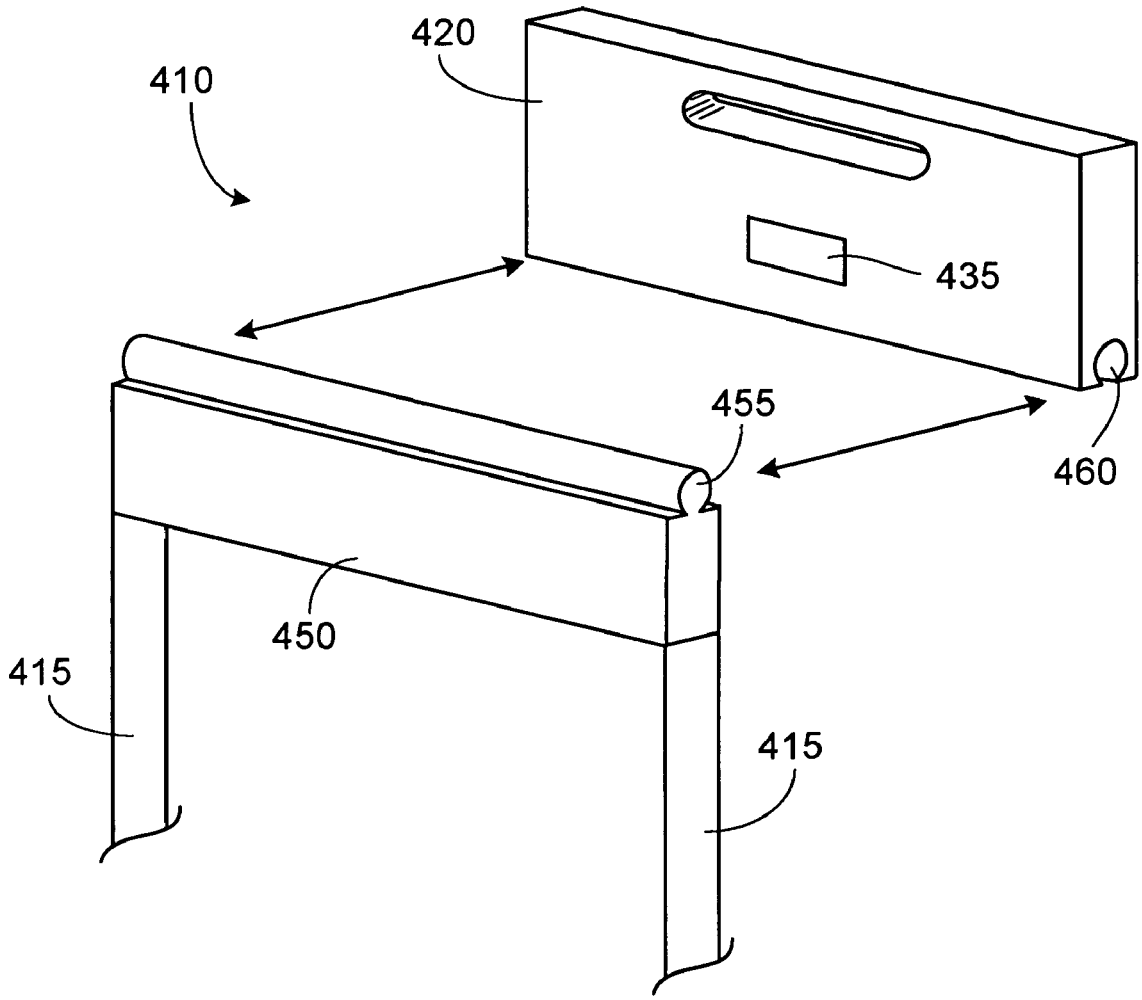
FIG. 7 is an exploded, perspective view of a luggage device handle with a detachable grip portion.

As yet another example, in some embodiments the grip portion of the handle can be detachable from the remainder of the handle. Referring to FIG. 7, for example, a luggage device handle 410 includes two parallel members 415 that are attached to and connected by a base portion 450. Base portion 450 includes a retaining feature 455, which extends along the length of base portion 450. A detachable grip portion 420 includes an electronic device 435. A slot 460 is formed to extend upward from the bottom surface of grip portion 420. Slot 460 is sized and shaped to receive retaining feature 455 as grip portion 420 is slid onto base portion 450. To attach grip portion 420 to base portion 450, grip portion 420 can be position beside base portion 450 such that slot 460 is aligned with retaining feature 455, and grip portion 420 can then be slid along the length of base portion 450. Grip portion 420 and/or base portion 450 can include a locking mechanism (e.g., a snap fastener) that prevents grip portion 420 from sliding off of base portion 450 when secured thereon. As an alternative to or in addition to the slot and retaining feature combination described above, any of various other fastening mechanisms can be used to secure grip portion 420 to base portion 450. Examples of suitable fastening mechanisms include mechanical latches (e.g., ball detent pins, spring loaded latches), electromagnetic latches, and fluid latches. Any of the various techniques described herein can be used to power electronic device 435. In some embodiments, handle 110 can include an electrical switch to activate and deactivate the electronic device as desired (e.g., upon extending and retracting the handle).

While the electrical switches have been described as button switches, any of various other types of electrical switches can be used. In some embodiments, the electrical circuiting extending between the electronic device(s) and the power source(s) includes a mechanical switch (e.g., a micro switch) that is positioned within the handle. The mechanical switch can be arranged to pop into a hole within the handle or body once the handle has been retracted to a predetermined level in order to interrupt the circuit and thus deactivate the electronic device. As an alternative to or in addition to mechanical switches, any of various other types of electrical switches can be used. Examples of other types of electrical switches include magnetic switches, optical switches, capacitance switches, and pressure switches (e.g., fluid couplings).

In some embodiments, rather than being automatically actuated as discussed above, the electrical switch can be manually activated. In such cases, the user can manipulate the switch to activate and deactivate the electronic device when desired.

While the embodiments above describe the electrical switch as being positioned within the handle of the luggage device, the switch can alternatively or additionally be positioned in various other regions of the luggage device. In certain embodiments, the switch is positioned within the body of the luggage device and is arranged to interact with the handle to activate and/or deactivate the electronic device.

As an additional example, while the handles of the embodiments above have been described as having two parallel members and a cross member, any of various other types of handles can be used. Examples of other types of handles include T-shaped handles and lever handles.

As another example, while the power source has been described as a battery in several embodiments above, any of various other types of power sources can alternatively or additionally be used. Examples of other types of power sources include electrochemical cells (e.g., fuel cells), photovoltaic cells (e.g., solar cells), A/C adapters, and microwave converters.

As an alternative to or in addition to the features described above, the luggage devices can include any of various other features. In some embodiments, for example, the luggage device is a modular luggage device. Examples of various types of modular luggage devices are described in U.S. Patent Application No. 60/695,322, filed Jun. 30, 2005, and entitled "Customizable Luggage Devices and Related Methods," which is incorporated by reference herein. In certain embodiments, the luggage devices include suspension systems. Examples of suspension systems are described in commonly owned U.S. Patent Application No. 60/599,510, filed Aug. 6, 2004, and entitled "Suspension for Wheeled Transport Devices," and in U.S. Patent Application No. 60/697,179, filed Jul. 7, 2005, and entitled "Suspension Systems," each of which is incorporated by reference herein. In some embodiments, the luggage devices include internal partitioning systems. Examples of internal partitioning systems are described in commonly owned U.S. Patent Application No. 60/599,420, filed Aug. 6, 2004, and entitled "Adaptable Luggage," which is incorporated by reference herein.

Other embodiments are in the claims.

What is claimed is:

1. A wheeled transport device configured to be manually wheeled by a pedestrian user, the transport device comprising:

a body defining a compartment configured to contain goods;

at least one wheel disposed at a lower portion of the body and secured to the body for rotation along a surface upon which the user is walking;

a handle attached to an upper portion of the body, the handle being configured to retract within a cavity defined by the body; and an electronic device mounted to the handle, the electronic device being configured to deactivate when the handle is retracted;

wherein the electronic device comprises at least one member selected from the group consisting of a WiFi locator, a clock, a custom computer, a PDA, a calculator, an expense counter, a cell phone, a GPS device, and a luggage locating device.

2. The wheeled transport device of claim 1, further comprising a switch configured to electrically connect the electronic device to a power supply.

3. The wheeled transport device of claim 2, wherein the switch is positioned within the handle.

4. The wheeled transport device of claim 2, wherein the switch is configured to disconnect electrical supply to the electronic device when the handle is retracted.

5. The wheeled transport device of claim 2, wherein the power supply is positioned within the body.

6. The wheeled transport device of claim 2, wherein the power supply comprises an electric generator operably coupled to the wheel and configured to produce electrical energy as the user wheels the device along the surface.

7. The wheeled transport device of claim 2, wherein the power supply is positioned within the handle.

8. The wheeled transport device of claim 2, further comprising an electrical contact configured to contact the switch when the handle is extended, the electrical contact being electrically connected to the electronic device.

9. The wheeled transport device of claim 8, wherein the electrical contact is positioned within the cavity.

10. The wheeled transport device of claim 1, wherein the electronic device is releasably attached to the handle.

11. The wheeled transport device of claim 10, wherein the electronic device is constructed to be retained within a recess defined by the handle.

12. The wheeled transport device of claim 1, wherein the handle is a telescoping handle.

13. The wheeled transport device of claim 1, wherein a plurality of electronic devices are mounted to the handle.

14. The wheeled transport device of claim 13, wherein the electronic devices are configured to be releasably mounted to the handle.

15. The wheeled transport device of claim 13, wherein at least some of the electronic devices are interchangeable with one another.

16. The wheeled transport device of claim 1, wherein the wheeled transport device comprises a wheeled luggage device.

17. A wheeled transport device configured to be manually wheeled by a pedestrian user, the transport device comprising:

a body defining a compartment configured to contain goods;

at least one wheel disposed at a lower portion of the body and secured to the body for rotation along a surface upon which the user is walking;

a handle attached to an upper portion of the body, the handle being configured to retract within a cavity defined by the body; and a WiFi locating device mounted to the handle, the WiFi locating device being adapted to detect WiFi signals.

18. The wheeled transport device of claim 17, wherein the WiFi locating device is configured to retract within the cavity when the handle is retracted.

19. The wheeled transport device of claim 18, wherein the WiFi locating device is not visible to a user when retracted within the cavity.

20. The wheeled transport device of claim 18, wherein the cavity is defined by relatively hard surfaces to protect the WiFi locating device from damage when the WiFi locating device is retracted.

21. The wheeled transport device of claim 17, wherein the WiFi locating device is configured to deactivate upon retracting the handle.

22. The wheeled transport device of claim 17, further comprising an electrical switch, the WiFi locating device comprising a contact member configured to electrically contact the electrical switch when the handle is extended.

23. The wheeled transport device of claim 17, further comprising a power supply adapted to provide power to the WiFi locating device.

24. The wheeled transport device of claim 23, wherein the power supply comprises an electric generator operably coupled to the wheel and configured to produce electrical energy as the user wheels the device along the surface.

25. The wheeled transport device of claim 24, wherein the electric generator is positioned within the body.

26. The wheeled transport device of claim 17, further comprising an indicator connected to the WiFi locating device, the indicator being adapted to indicate a strength of the WiFi signals detected by the WiFi locating device to a user.

27. The wheeled transport device of claim 26, wherein the indicator is mounted to the handle.

28. The wheeled transport device of claim 17, wherein the wheeled transport device comprises a wheeled luggage device.

29. A wheeled transport device configured to be manually wheeled by a pedestrian user, the transport device comprising:

a body defining a compartment configured to contain goods;

at least one wheel disposed at a lower portion of the body and secured to the body for rotation along a surface upon which the user is walking;

a handle attached to an upper portion of the body, the handle being configured to retract within a cavity defined by the body, the handle comprising a first portion and a second portion that is detachable from the first portion; and an electronic device mounted to the second portion of the handle;

wherein the first and second portions of the handle comprise mating features adapted to engage one another to secure the first and second portions to one another, the mating features comprising a projection and a slot configured to receive the projection.

30. The wheeled transport device of claim 29, wherein the handle comprises a locking member adapted to lock the first and second portions in a joined configuration.

31. The wheeled transport device of claim 30, wherein the locking member comprises a mechanical fastener.

32. The wheeled transport device of claim 29, further comprising a power supply adapted to provide the electronic device with energy.

33. The wheeled transport device of claim 32, wherein the first portion of the handle comprises electrical contacts electrically connected to the power supply, the electrical contacts of the first portion configured to mate with electrical contacts of the second portion when the first and second portions are secured to one another.

34. The wheeled transport device of claim 32, wherein the power supply comprises an electric generator operably coupled to the wheel and configured to produce electrical energy as the user wheels the device along the surface.

35. The wheeled transport device of claim 29, wherein the wheeled transport device comprises a wheeled luggage device.

36. A wheeled transport device configured to be manually wheeled by a pedestrian user, the transport device comprising:

a body defining a compartment configured to contain goods;

at least one wheel disposed at a lower portion of the body and secured to the body for rotation along a surface upon which the user is walking;

a handle attached to an upper portion of the body, the handle being configured to retract within a cavity defined by the body; and an electronic device mounted to the handle, the electronic device being configured to deactivate when the handle is retracted;

wherein the electronic device is releasably attached to the handle and constructed to be retained within a recess defined by the handle.

37. The wheeled transport device of claim 36, further comprising a switch configured to electrically connect the electronic device to a power supply.

38. The wheeled transport device of claim 37, wherein the switch is positioned within the handle.

39. The wheeled transport device of claim 37, wherein the switch is configured to disconnect electrical supply to the electronic device when the handle is retracted.

40. The wheeled transport device of claim 37, wherein the power supply comprises an electric generator operably coupled to the wheel and configured to produce electrical energy as the user wheels the device along the surface.

41. The wheeled transport device of claim 37, further comprising an electrical contact configured to contact the switch when the handle is extended, the electrical contact being electrically connected to the electronic device.

42. The wheeled transport device of claim 41, wherein the electrical contact is positioned within the cavity.

43. The wheeled transport device of claim 38, wherein the wheeled transport device comprises a wheeled luggage device.

44. A wheeled transport device configured to be manually wheeled by a pedestrian user, the transport device comprising:

a body defining a compartment configured to contain goods;

at least one wheel disposed at a lower portion of the body and secured to the body for rotation along a surface upon which the user is walking;

a handle attached to an upper portion of the body, the handle being configured to retract within a cavity defined by the body; and a plurality of electronic devices releasably mounted to the handle, the electronic devices being configured to deactivate when the handle is retracted, at least some of the electronic devices being interchangeable with one another.

45. The wheeled transport device of claim 44, further comprising a switch configured to electrically connect the plurality electronic devices to a power supply.

46. The wheeled transport device of claim 45, wherein the switch is positioned within the handle.

47. The wheeled transport device of claim 45, wherein the switch is configured to disconnect electrical supply to the plurality electronic devices when the handle is retracted.

48. The wheeled transport device of claim 45, wherein the power supply comprises an electric generator operably coupled to the wheel and configured to produce electrical energy as the user wheels the device along the surface.

49. The wheeled transport device of claim 45, further comprising an electrical contact configured to contact the switch when the handle is extended, the electrical contact being electrically connected to the plurality of electronic devices.

50. The wheeled transport device of claim 44, wherein the wheeled transport device comprises a wheeled luggage device.

51. A wheeled transport device configured to be manually wheeled by a pedestrian user, the transport device comprising:

a body defining a compartment configured to contain goods;

at least one wheel disposed at a lower portion of the body and secured to the body for rotation along a surface upon which the user is walking;

a handle attached to an upper portion of the body, the handle being configured to retract within a cavity defined by the body, the handle comprising a first portion and a second portion that is detachable from the first portion;

an electronic device mounted to the second portion of the handle; and a power supply adapted to provide the electronic device with energy;

wherein the first portion of the handle comprises electrical contacts electrically connected to the power supply, the electrical contacts of the first portion configured to mate with electrical contacts of the second portion when the first and second portions are secured to one another.

52. The wheeled transport device of claim 51, wherein the first and second portions of the handle comprise mating features adapted to engage one another to secure the first and second portions to one another.

53. The wheeled transport device of claim 51, wherein the handle comprises a locking member adapted to lock the first and second portions in a joined configuration.

54. The wheeled transport device of claim 53, wherein the locking member comprises a mechanical fastener.

55. The wheeled transport device of claim 51, wherein the power supply comprises an electric generator operably coupled to the wheel and configured to produce electrical energy as the user wheels the device along the surface.

56. The wheeled transport device of claim 51, wherein the wheeled transport device comprises a wheeled luggage device.

* * * * *

UNITED STATES PATENT AND TRADEMARK OFFICE

CERTIFICATE OF CORRECTION

PATENT NO. : 7,338,053 B2
APPLICATION NO. : 11/448417
DATED : March 4, 2008
INVENTOR(S) : Douglas C. Dayton It is certified that error appears in the above-identified patent and that said Letters Patent is hereby corrected as shown below:

Column 13, line 31:
Delete "38" and replace with --36--.

Signed and Sealed this

Second Day of December, 2008

JON W. DUDAS
*Director of the United States Patent and Trademark Office*